US009810061B2

(12) United States Patent
Levitov

(10) Patent No.: US 9,810,061 B2
(45) Date of Patent: Nov. 7, 2017

(54) METHOD AND DEVICE FOR SELECTING AND MAINTAINING HYDRODYNAMICALLY CONNECTED WELLS

(71) Applicant: Yevgeny B. Levitov, San Antonio, TX (US)

(72) Inventor: Yevgeny B. Levitov, San Antonio, TX (US)

(73) Assignee: WELL-SMART TECHNOLOGIES GLOBAL, INC, Reno, NV (US)

( * ) Notice: Subject to any disclaimer, the term of this patent is extended or adjusted under 35 U.S.C. 154(b) by 0 days.

(21) Appl. No.: 15/408,568

(22) Filed: Jan. 18, 2017

(65) Prior Publication Data

US 2017/0122098 A1 May 4, 2017

Related U.S. Application Data

(63) Continuation-in-part of application No. 15/239,048, filed on Aug. 17, 2016, now Pat. No. 9,580,997, (Continued)

(51) Int. Cl.
*E21B 28/00* (2006.01)
*G01V 1/42* (2006.01)
(Continued)

(52) U.S. Cl.
CPC ..... *E21B 49/00* (2013.01); *E21B 28/00* (2013.01); *E21B 43/003* (2013.01)

(58) Field of Classification Search
CPC ... G01V 1/40; G01V 1/42; G01V 1/48; G01V 1/50; E21B 28/00; E21B 43/003
(Continued)

(56) References Cited

U.S. PATENT DOCUMENTS 5,963,508 A * 10/1999 Withers ..... G01V 1/008 166/250.1
6,009,043 A * 12/1999 Chon ..... G01V 1/42 367/57

(Continued)

*Primary Examiner* — Kenneth L Thompson
(74) *Attorney, Agent, or Firm* — Nadya Reingand; Yan Hankin

(57) ABSTRACT

Disclosed are methods, systems, and devices for increasing well and oil field productivity. The method comprises positioning an acoustic device in a well located within the geological formation and performing an acoustic treatment impacting a muddled zone in cycles comprising one or more manipulated waves of ultrasonic pressure on the muddled zone. The cycles comprise a Fourier transformation of a periodic function. The transformation determines a rate at which an acoustic treatment pressure of each cycle rises from zero to a maximum value. This rate is directly proportional to a force of an impact on the formation, and the greater the rate, the greater the impact. The acoustic treatment can further be detected by placing emitters and receivers in surrounding wells and calculating the signal received to determine if wells are hydrodynamically connected, such that a synergistic effect may be achieved through simultaneous treatment at several well locations.

19 Claims, 13 Drawing Sheets

Related U.S. Application Data which is a continuation-in-part of application No. 14/953,151, filed on Nov. 27, 2015, now Pat. No. 9,447,669, which is a continuation-in-part of application No. 14/508,081, filed on Oct. 7, 2014, now Pat. No. 9,228,419, which is a continuation-in-part of application No. 14/218,533, filed on Mar. 18, 2014, now Pat. No. 8,881,807.

(60) Provisional application No. 61/802,846, filed on Mar. 18, 2013.

(51) Int. Cl.
*G01V 1/50* (2006.01)
*E21B 49/00* (2006.01)
*E21B 43/00* (2006.01)

(58) Field of Classification Search
USPC ..... 166/52, 313, 250.01; 181/101, 102, 106, 181/104, 113, 119, 122
See application file for complete search history.

(56) References Cited

U.S. PATENT DOCUMENTS

| | | | | |
|---|---|---|---|---|
| 6,175,536 | B1 * | 1/2001 | Khan | G01V 1/42 367/30 |
| 6,462,549 | B1 * | 10/2002 | Curtis | G01V 3/082 181/122 |
| 6,597,632 | B2 * | 7/2003 | Khan | G01V 1/288 367/32 |
| 7,046,581 | B2 * | 5/2006 | Calvert | G01V 1/42 367/38 |
| 8,881,807 | B1 * | 11/2014 | Orentlikherman | E21B 28/00 166/177.2 |
| 9,169,726 | B2 * | 10/2015 | Snedden | E21B 49/008 |
| 9,228,419 | B1 * | 1/2016 | Orentlikherman | E21B 43/003 |
| 9,447,669 | B2 * | 9/2016 | Levitov | E21B 43/25 |
| 9,580,997 | B2 * | 2/2017 | Levitov | E21B 47/00 |
| 2012/0116681 | A1 * | 5/2012 | Fuller | G01N 15/08 702/12 |

* cited by examiner

| Graph $f(t)$ | Fourier series of function $f(t)$ | Notes |
|---|---|---|
| 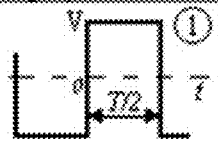 | $f(t)=\frac{4V}{\pi}\sum_{k=1}^{\infty}\frac{\sin k\omega t}{k}$ | k=1,3,5,... $\omega=\frac{2\pi}{T}$ |
| 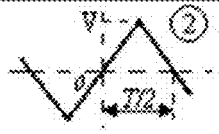 | $f(t)=\frac{8V}{\pi^2}\sum_{k=1}^{\infty}(-1)^{\frac{k-1}{2}}\frac{\sin k\omega t}{k^2}$ | k=1,3,5,... $\omega=\frac{2\pi}{T}$ |
| 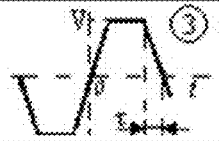 | $f(t)=\frac{4V}{\omega\tau\pi}\sum_{k=1}^{\infty}\frac{\sin k\omega\tau}{k^2}\sin k\omega t$ | k=1,3,5,... $\omega=\frac{2\pi}{T}$ |

Fig. 9(a)

| Graph $f(x)$ | Fourier series of function $f(x)$ |
|---|---|
| 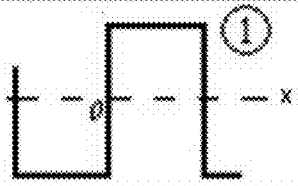 | $f(x)=\frac{A}{2}+\frac{2A}{\pi}\sum_{k=1}^{\infty}\frac{1}{2k-1}\sin\left(\frac{2k-1}{L}\pi x\right)$ |
| 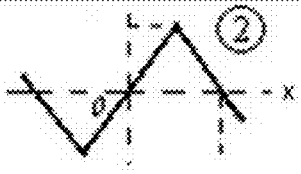 | $f(x)=\frac{1}{4}+\sum_{n=1}^{\infty}\left[\frac{\left((-1)^n-1\right)}{n^2\pi^2}\cos n\pi x+\frac{(-1)^{n+1}}{n\pi}\sin n\pi x\right]$ |
| 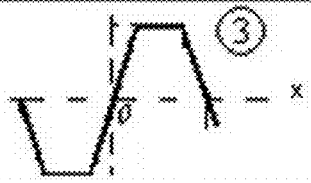 | $f(x)=\frac{2}{3}-\frac{3}{\pi^2}\sum_{n=1}^{\infty}\frac{1-\cos\frac{2n\pi}{3}}{n^2}\cos\frac{2n\pi x}{3}$ |

Fig. 9(b)

METHOD AND DEVICE FOR SELECTING AND MAINTAINING HYDRODYNAMICALLY CONNECTED WELLS

CROSS-REFERENCE TO RELATED APPLICATIONS

This patent application is a Continuation-in-Part of U.S. patent application Ser. No. 15/239,048, filed Aug. 17, 2016, now allowed, which is a Continuation-in-Part of U.S. patent application Ser. No. 14/953,151, filed Nov. 27, 2015, now U.S. Pat. No. 9,447,669, which is a Continuation-in-Part of U.S. patent application Ser. No. 14/508,081, filed Oct. 7, 2014, now U.S. Pat. No. 9,228,419, which is a Continuation-in-Pan of U.S. patent application Ser. No. 14/218,533, filed Mar. 18, 2014, now U.S. Pat. No. 8,881,807, all of which claim priority to U.S. Provisional Patent Application No. 61/802,846, filed Mar. 18, 2013, and all of which are incorporated herein by reference in their entireties.

FIELD OF THE INVENTION

This invention relates to the oil and gas industry and the optimization of oil and gas recovery rates from a geological formation, resulting in increased oil and gas recoverable reserves, stable, increased oil production, and reduced water cut.

BACKGROUND OF THE INVENTION

Currently, there exist several different methods for impacting a formation to facilitate the production processes of oil and gas, including several chemical methods, which are the methods most widely used.

Currently used methods, however, have a host of disadvantages, including but not limited to the following:

1. Low impact selectivity. For example, insulation procedures on a washed formation can lead to the sealing of effectively working, sub-layers.
2. Shallow reagent penetration depth into a formation.
3. Significant adsorption of many reagents, for example SAS, leading to unnecessarily high reagent losses and increased costs.
4. Increased environmental risks.
5. High overall cost.

The closest analog to the proposed invention is RF Patent No. 2143554, entitled ACOUSTIC METHOD FOR IMPACTING A WELL, which includes treating the well using an acoustic field with the goal of restoring filtration ability in the bottom zone. The process, however, only applies to one well, improving productivity in only one area.

In general, during oil (or gas) field maintenance, water delivery may be used through the system to support stratum pressure. A problem associated with such systems is muddling of the bottom hole zone, which lowers injected water volume, and dysregulates efficient water delivery into the formation. There exists a need to clean and keep the bottom hole zone from muddling, to restore fluid conductivity of well systems, and to increase well injectivity. There also exists a need for improving the productivity of more than one area of a well field or formation, or the field or formation in its entirety. Ultrasonic treatment of such wells usually employs a power wave comprising various symmetrical configurations of various frequencies of period functions, e.g., the sinus (or sine) wave. This sine-like power wave generated by a standard power supply or generator for equipment for ultrasonic liquid well restoration results in an ultrasonic pressure impact which is not optimal, in some situations, the power wave is insufficiently high or impactful in order to break cloaking materials collecting in the perforation zone, as well as in the liquid pool around the perforation zone. Due to the smooth front of the impact wave, the cleaning (and disrupting) ability of the power wave on cleaning liquid well zones is not optimal. The present invention addresses these particular needs.

SUMMARY OF THE INVENTION

The present invention discloses a method for restoring, maintaining, or increasing oil or gas productivity of a geological formation via locating maximum hydrodynamic connectivity between wells located in said geological formation. The method comprises the following steps: (1) positioning a first acoustic/ultrasonic device in a first well located within the geological formation, (2) positioning one or more additional acoustic/ultrasonic devices in one or more additional wells located within the geological formation, (3) emitting one or more signals in one or more ranges, said emitting being performed by said first device, said one or more signals comprising both ultrasonic and acoustic signals, wherein the one or more signals comprises a Fourier transformation of a periodic function, (4) receiving of said one or more signals, said receiving being, performed by a receiver located on the one or more additional devices, (5) standardizing said one or more signals received, said standardizing being based at least in part on a distance between said one or more additional wells and said first well, thus forming one or more standardized figures representing each signal received, and (6) determining, a value representing a likelihood of hydrodynamic connectivity between said first well and said second well, said value being based on a comparison of signals.

In some aspects, the determining step is based on a proportionality between emitted signals and received signals. In some aspects, the determining step is based on a relativity between two or more received signals, said relativity being calculated based on a known emission from said first device.

In some aspects, the method further comprises the step of (7) performing an acoustic treatment comprising a joint processing of the first well and any additional wells determined to be hydrodynamically connected to the first well (this determination is based on the value determined in step 6 of the method.

In some aspects, the determining step accounts for a decrease in wave amplitude due to a distance of said additional well from said first well. In some aspects, the determining step accounts for an ultrasound scattering by medium non-homogeneities. In some aspects, the determining step accounts for an absorption of ultrasound or an absorption of an acoustic signal (i.e. a signal being transmitted but losing amplitude/power due to absorption into the formation during travel to a receiving device). In some aspects, the absorption of ultrasound or the absorption of an acoustic signal is accounted for by the formula, $\alpha$ (dB/m)=8,686$\alpha$ (1/m).

In some aspects, the value representing a likelihood of hydrodynamic connectivity between said first well and said second well is compared to a second value, the second value being based on a second signal received by said one or more additional devices, said second value representing a level of environmental noise within the formation, wherein matching values indicate a non-connected well system, and wherein nonmatching values indicate a hydrodynamically connected well system.

In some aspects, the first well is a most productive well within said geological formation.

In some aspects, the determining step is based on known geophysical data. In some aspects, the determining step is performed without knowing geophysical data of said geological formation.

In some aspects, the method comprises using at least two additional devices in at least two additional wells (cf., exactly one additional device in one well), such that a third device is placed in at least one tertiary well, wherein one of said at least two additional wells is known to be hydrodynamically connected to said first well, and wherein a connectivity between said first well and said at least one tertiary well is determined based on a comparison between signals received at each of said at least two additional wells.

Also claimed is as system for restoring, maintaining, or increasing oil or gas productivity of a geological formation via determining hydrodynamic connectivity values between wells located in said geological formation. The system comprises the following units: (1) a first acoustic/ultrasonic device positioned in a first well located, within the geological formation, (2) one or more additional acoustic/ultrasonic devices positioned in one or more additional wells located within the geological formation, wherein said first acoustic/ultrasonic device emits one or more signals in one or more ranges, said emitting being performed by said first acoustic/ultrasonic device, said one or more signals comprising both ultrasonic and acoustic signals, wherein the one or more signals comprises a Fourier transformation of a periodic function, (3) a receiver for receiving of said one or more signals, said receiver being located on said one or more additional acoustic/ultrasonic devices, (4) a processor for standardizing said one or more signals received, said processing being based at least in part on a distance between said one or more additional wells and said first well, said processor forming one or more standardized figures representing each signal received, and (5) a calculator, said calculator determining a value representing a likelihood of hydrodynamic connectivity between said first well and said second well, said value being based on a comparison of signals.

In some aspects, the first well is a most productive well within the geological formation.

In some aspects, the value representing a likelihood of hydrodynamic connectivity between said first well and said second well is compared to a second value, the second value being based on a second signal received by said one or more additional acoustic/ultrasonic devices, said second value representing a level of environmental noise within the formation, wherein matching values indicate a non-connected well system, and wherein non-matching values indicate a hydrodynamically connected well system.

In some aspects, at least two additional acoustic/ultrasonic devices in at least two additional wells are used, such that a third acoustic/ultrasonic, device is placed in at least one tertiary well, wherein one of said at least two additional wells is known to be hydrodynamically connected to said first well, and wherein a connectivity between said first well and said at least one tertiary well is determined based on a comparison between signals received at each of said at least two additional wells.

In some aspects, the system further performs steps relating to an acoustic treatment of the wells and the formation, said acoustic treatment comprising a joint processing of the first well and any additional wells determined to be hydrodynamically connected to the first well.

In some aspects, the processor accounts for all three of: (1) a decrease in wave amplitude due to a distance of said additional well from said first well, (2) an ultrasound scattering by medium nonhomogeneities and (3) an absorption of ultrasound. In some aspects, the absorption of ultrasound is accounted for by the formula, $\alpha$ (dB/m)=8.686$\alpha$ (1/m).

BRIEF DESCRIPTION OF THE DRAWINGS

FIG. 9(*a*) shows a table explaining three example modifications according to the present invention, as well as their Fourier series equation. FIG. 9(*b*) shows another table with the same examples as FIG. 9(*a*), however the equations in FIG. 9(*a*) are simplified versions of the equations in FIG. 9(*b*) and are written on physics-based parameters, such as time and voltage. FIG. 9(*c*) shows a graph of the shape of the wave according to Row 1 of the tables in FIGS. 9(*a*) and 9(*b*). FIG. 9(*d*) shows a graph of the shape of the wave according to Row 2 of the tables in FIGS. 9(*a*) and 9(*b*). FIG. 9(*e*) shows a graph of the shape of the wave according to Row 3 of the tables in FIGS. 9(*a*) and 9(*h*).

DETAILED DESCRIPTION OF THE PREFERRED EMBODIMENT

Definitions

Figure 1:
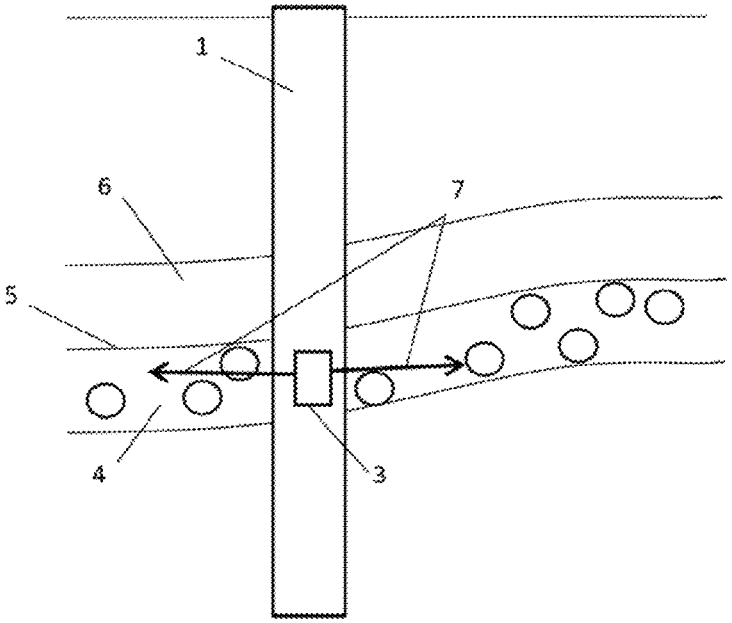
FIG. 1 shows a side cross-sectional view of one embodiment of the present invention, where an acoustic device is placed within a well.

"Angle α," as used herein, is defined, as the angle corresponding to the slope corresponding to the rate at which the pressure (P) of an acoustic treatment increases from a value of zero to a maximum value, before the pressure drops back down to zero, following the wave function defining, the particular treatment. Angle α determines, or is determined by, the shape of the wave which in turn defines the power of the explosive impact achieved on the perforation zone or other zone of a well. In other words, the angle α is the angle formed between the line depicting the pressure wave and the horizontal (x-) axis of the same graph. It is noted that the term, "Angle α," is not intended to relate to the term, "α," as referred to in Formulas 1, 3, and 5, hereinbelow. These two terms should be read as having unrelated definitions and representations.

"Manipulated wave," as used herein, is defined as a wave that is modified via a Fourier transformation from a normal periodic (e.g., sine or sinus) wave form. Such a pressure wave can be manipulated to form any shape ranging from a U-shape (i.e. parabolic) to any triangle shape. Examples of manipulated waves as employed by the present invention include but are not limited to U-shaped waves, trapezoidal waves, and sawtooth (or sawtooth-shaped) waves. The term "power wave," as used herein, may be used interchangeably with "pressure wave."

"Cycle(s)," as used herein, is defined as an acoustic treatment corresponding to a main peak, as shown in the figures. The figures reference cycles via the label "FL" (FL1, FL2, FL3).

"Packet(s)," as used herein, is defined as an acoustic treatment that is contained within a cycle (and thus within a main peak), such that a combination of packets may be contained within each cycle. Packets may also be referred to as "filling frequencies" herein. The figures reference packets via the label "FH" (FH1, FH2, FH3).

"Full-spectrum receiver," or simply "receiver," as used herein, is defined as a device that emits and receives both ultrasound and acoustic vibrations (but may only do one of the emitting or receiving) in order to, e.g., select the optimal wells out of a formation/system of wells, and with which the acoustic/ultrasound device (or simply, "device") according to the present invention may be further equipped. The full-spectrum receiver of vibrations emitted by the transmitter(s) located in other wells is referred to herein as such (i.e., full-spectrum receiver).

The claimed method comprises emitting complex acoustic vibrations on the perforated zones of a well, at specific interlayers of a well, and/or on the filters in horizontal wells. The perforated interval and productive strata of the reservoir are thus sequentially and specifically treated with a directed acoustic field. The pressure, time, and range of the acoustics are correlated and applied in various combinations depending on detected characteristics of the specific well and the formation within the well. Power waves in the audible and ultrasound ranges, with 360 degree directional characteristics (i.e. in all directions), provide acoustic pressures from a minimum value, necessary to cause changes in an active production well, to a maximum value, which is limited by the elasticity and other characteristics of the formation. The duration of the exposure is based on the effective exposure time, which also depends on characteristics of the individual well and the formation within it. The acoustic effect has an effective exposure range starting from 0.05 meters and is limited only by the geological characteristics of the formation. Acoustic effects can be created in a basic mode—with sequential processing of the wellbore production strata interval using three acoustic power waves.

The present invention improves upon the prior art by performing acoustic treatment in at least two areas of a well field or well system. FIG. 1 shows acoustic device 3 is positioned within a particular well 1. The acoustic device 3 is positioned at or nearby the water layer 4, such that the acoustic processing creates an impact on the water layer to increase the water injection rate 7. The water layer 4 and the oil/gas layer 6 maintain contact at the water-oil contact layer 5, where the water and oil exist in mixed form. Essentially, the acoustic devices 3 may be programmed to create any dynamic acoustic impact in any direction desired, based on the desired effects on well, productivity and function.

Figure 2:
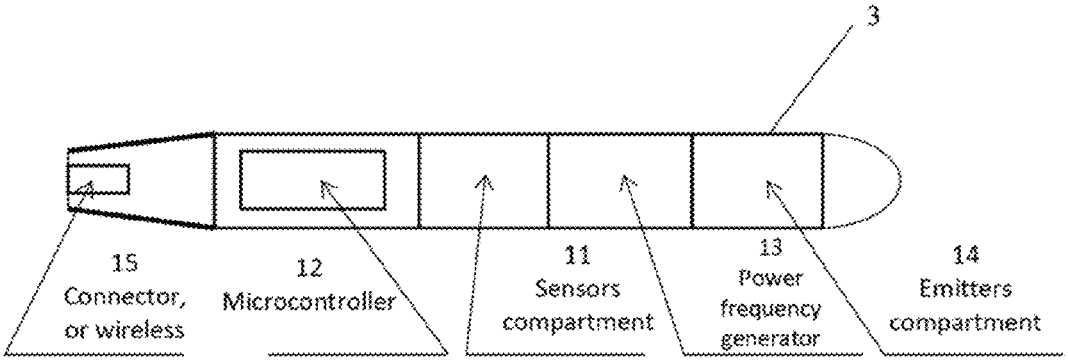
FIG. 2 shows an example of the various components of one embodiment of the acoustic device.

FIG. 2 discloses the acoustic device 3 in more detail. The sensors compartment 11 measures conditions in the well (such as temperature of the formation, static and dynamic pressures in the collector zone, density and viscosity of the fluid) and transmits data to the microcontroller 12, which calculates the first parameters for well processing based on these data and geophysical information and transmits the data to the frequency generator 13. The generator 13 sends an acoustic/ultrasonic pulse to the emitters compartment 14 and well processing is performed according to the diagram FIG. 6. The connector module 15 provides connection between the acoustic device 3 and a control unit on the ground (not shown). It can be wired or wireless.

To increase effectiveness and reduce duration of acoustic/ultrasonic processing of fluid well, a method of packet impacting the muddled zone of the fluid well is used. This alternates applying acoustic/ultrasonic pressure on the muddled zone and then dropping it off to zero. One processing cycle (cycle time—CT) consists of pressure time (PT) and relaxation time (RT), see FIG. 3. After this the operating cycle repeats again, pulsed acoustic impact leads to loosening, of the muddled layer, removal of particulates muddling the layer, and more effective dispersal from the muddled zone.

Cycle configuration depends on the composition of the contamination and composition of the soil which surrounds the contamination zone. In the cycle, relaxation time (RT) does not have to equal the pressure time (PT) on the contaminated zone. Both the pressure time and relaxation time depend on the size of the contaminant particulates and their qualitative composition and is a function of parameters such as porosity (%), initial and current permeability (α), density and viscosity of fluid in the well, saturation pressure (μ), concentration and composition of salts, sulphur, wax, tar, asphalt, well pressure (p), formation temperature (t). These parameters, including formation temperature, static and dynamic pressures in the collector zone, fluid density and viscosity are measured by device sensors 11. The remaining parameters are installed based on geophysical studies performed or on corresponding sensor availability.

Due to the heterogeneity of the muddled zone and irregular particulates (from 10 nm to 0.01 mm) comprising the muddled layer, the most critical parameters are the sizes of particulates contaminating the bottom hole zone and the collector zone. Therefore, the acoustic/ultrasonic processing may occur in three stages, each stage potentially comprising a processing at different frequencies. It is noted that processing may further comprise both cycles and packets. Various treatments may comprise differences between cycle and packet frequencies. For example, the cycle frequency, FL1, of the first stage may range from 0.5 Hz to 4 Hz, with a packet frequency, FH1, in the range of 4 kHz to 7 kHz (see FIG. 3). In an exemplary second stage, the cycle frequency ranges from 4 HZ to 10 Hz, with a packet frequency ranging, from 7 kHz to 14 kHz (see FIG. 4). In an exemplary third stage, the cycle frequency ranges between 14 kHz and 22 kHz, with a packet frequency ranging from 10 Hz to 100 Hz (see FIG. 5). Alternatively, treatment may comprise three stages comprising three cycling frequencies without any packets or packet frequencies (i.e. filling frequencies), according to the following, frequency ranges: (1) 4 kHz to 7 kHz, (2) 7 kHz to 14 kHz, and (3) 14 kHz to 22 kHz, Emission power (P1, P2, and P3) varies from 0 to 5 kW or greater and depends on the condition of the well and bottom hole zone. In one embodiment, the emission power varies during the treatment with the same cycle frequency. In another embodiment, the emission power may not vary.

In one embodiment the treatment frequency is selected to achieve a resonant oscillation in a perforated well zone.

Growth of a packet front 21 should occur along an exponential or other growth curve to prevent a water hammer, which can lead not to the structural breakdown of contamination, but to flattening (like clay) of the front wall of the muddled layer, adjacent to the source of the emission. In another embodiment, the front growth is along semi-parabola.

Relaxation time (RT) in the cycle is determined based on the input parameters and can be equal to the processing time in the cycle, greater than, less than the processing time or equal to 0 (in the cycle) depending on the input parameters and formation parameters.

Figure 6:
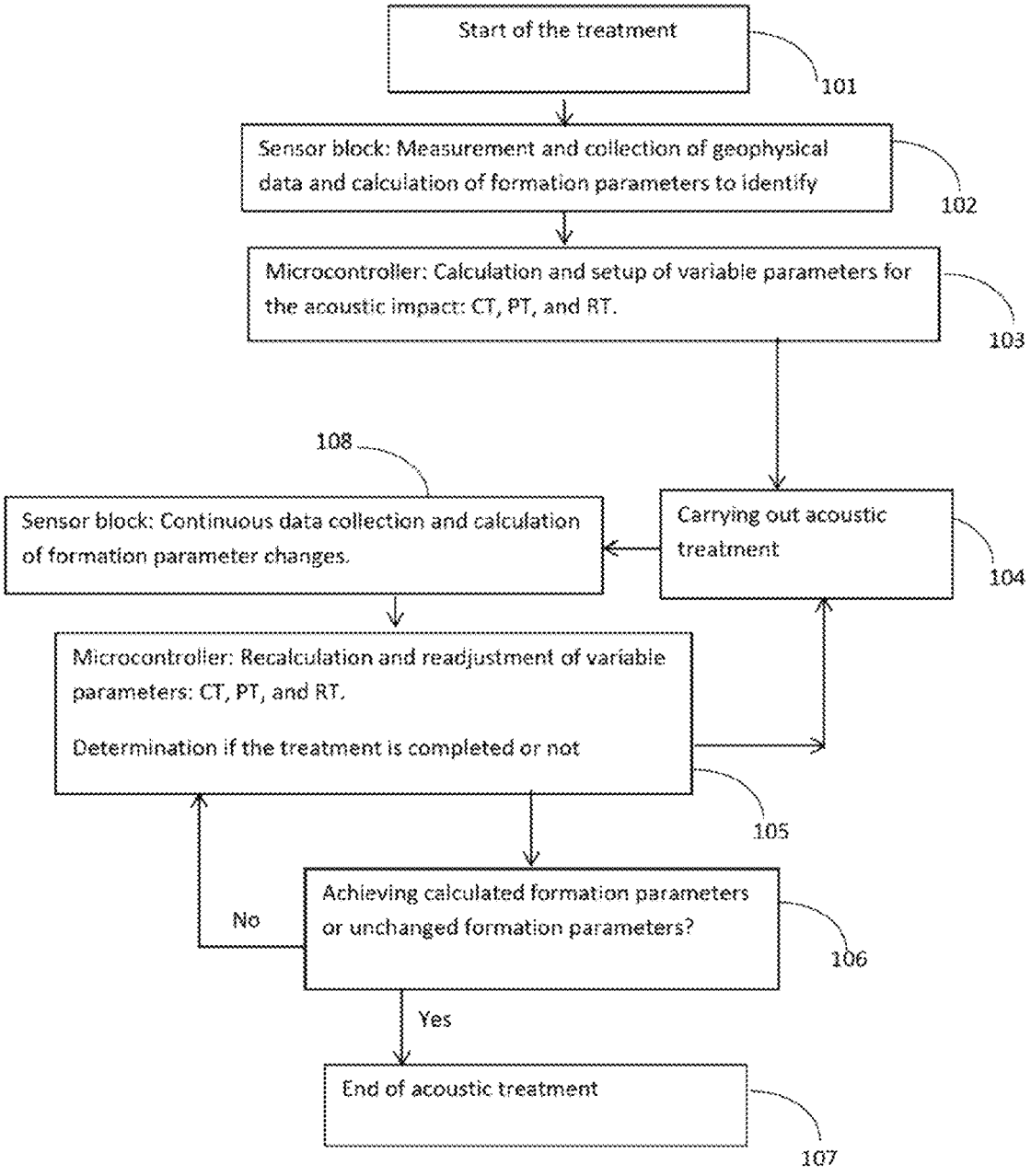
FIG. 6 is a flowchart detailing one embodiment of the method of the present invention.
Figure 7:
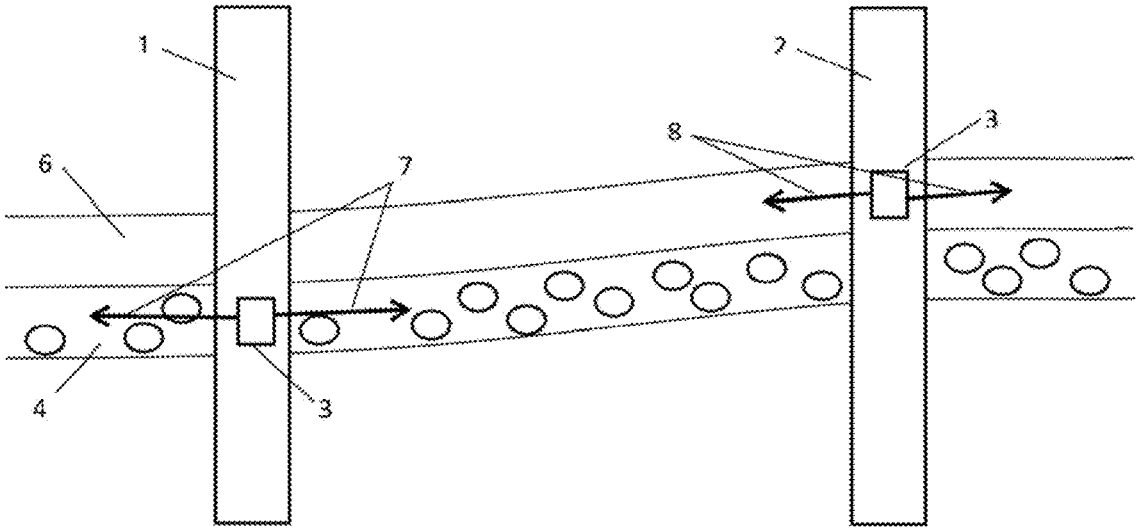
FIG. 7 shows a side cross-sectional view of the embodiment with two wells.

FIG. 6 shows an operation flow chart from the start 101, to the end 107, for one embodiment of the present invention:

1. Sensor block performs collection of geophysical data to meet initial criteria, for required treatment and calculation of formation parameters to identify those formation parts, or areas, which are decreasing productivity (for example, based on a chart of the speed of production decline; a higher speed of production decline would suggest a need for treatment) 102;

2. Microcontroller block, performs calculation and setup of variable parameters CT, PT, and RT 103. Using the input parameters and criteria for acoustic impact optimization, the initial equipment setup is determined for the given resource deposit conditions;

3. Carrying out acoustic treatment 104;

4. Sensor block performs continuous data collection and calculation of formation parameter changes as acoustic treatment continues 108;

5. Microcontroller block performs determination whether the treatment and setup parameters are either achieving the desired formation parameters or maintaining formation parameters 105;

6. Microcontroller block performs recalculating and adjusting. (i.e. optimizing) of the variable setup parameters selected for acoustic treatment when desired formation parameters are not achieved or maintained 105 (feedback loop); and 7. Ending, or continuing, with acoustic treatment when desired formation parameters are achieved or maintained 107.

Treatment (i.e. acoustic processing) of two or more key wells (or key well areas) increases productivity and decreases the water component (water cut) of entire oil or gas fields, affecting even those wells which are not directly treated. The present invention further improves upon the prior art by including a feedback loop method for evaluating and re-evaluating the effect of an acoustic impact from multiple devices in multiple wells. The feedback loop further gives an ability to optimize operation parameters without stopping the welling process or the acoustic process. The present invention further improves upon the prior art by disclosing how the typical sine-like or other period function power wave generated by power supplies for such well restoration/maintenance systems may be modified in order to achieve a more optimal and effective impact on the perforation zone and the liquid pool near the perforation zone of a well system.

The present invention may be used to increase formation productivity by improving, hydrodynamic connection(s) between wells by restoring and optimizing the filtration characteristics of the bottom-hole zone of a well or well system. The method comprises causing a synergistic effect from acoustic fields (at least two) on the well bore zones of at least an adjacent pair of injection and/or production wells or any group of connected wells. The effect of the acoustic fields is apparent on site (i.e. near the acoustic device creating the effect) as well as throughout an entire formation or well field, "Adjacent pair," as used herein, is defined as a pair of any type of well one production well with one injection well, two production wells, two injection wells, and any combination thereof). The term "pair" does not limit, in any way, the number of wells which may be hydrodynamically connected and acoustically process, as described herein. The setup may include 3 total wells, wherein one is an injection well and two are production wells, or wherein one is a production well and two are injection wells (or 4, 5, 6 total wells, etc.). The only constraint on the combinations of types and amounts of wells is on the physical possibility for the existence of hydrodynamic connections between actual wells (i.e., any hydrodynamically connected well system improves by employing the present invention).

Devices employed by the method of the present invention may be wired, wireless, or any other. The devices used for acoustic processing (at least two: one for positioning within each of the at least two wells) are further selected based on the analysis of the hydrodynamic relationship between injection and production for specific well groups and for the formation as a whole. Wells having a hydrodynamic relationship are connected via channels and/or capillaries located beneath the ground. Any change in the parameters of a well with a hydrodynamic connection to another well will, in turn, affect the parameters of other wells via the hydrodynamic connection. For example, if after acoustic treatment, an injection well experiences increased hydrodynamic pressure, this will increase production in any hydro-dynamically connected production well(s). The feedback loop included in the method will record information regarding production and the formation, allowing for optimization of process parameters for best production results.

Acoustic processing (i.e., a dynamic acoustic effect, achieved by one or more acoustic devices positioned within the well) may begin simultaneously in both wells of a hydrodynamically connected group of wells. Alternatively, those wells selected, from the injection group may first be processed acoustically to redistribute the injection profile of the displacing agent. And subsequently, the corresponding production wells are processed acoustically with the aim of changing filtration stream directions in adjacent formation zones. Acoustic processing is carried out using several frequency bands, which are selected based on the filtration capacity characteristics of a particular interval, and is further optimized by adjusting the processing parameters based on data collected during the initial stage. The acoustic impact may either be continuous or be performed at calculated intervals of time. FIG. 1, FIG. 2)

Well perforation intervals are processed acoustically point-by-point within each well and selectively in zones of elevated filtration resistance, which may be determined, for example, by preliminary geophysical investigations. Processing parameters may be corrected on the basis of data obtained and analyzed during the initial stages of processing as well as any later stage, if parameters change, or as otherwise needed.

In order to correct processing parameters, it is necessary to evaluate the fluid mobility in the porous channels during the acoustic impact via formation parameters such as length and capacity. In other words, it is necessary to identify parts of the formation where the stationary fluid is located, and, accordingly, to determine zones for application of the aforementioned method. The formation parameters monitored include but are not limited to the following inputs/information, collected during the well drilling process, measured by geophysical instruments, and/or calculated based on geophysical research and measurements:

1. Porosity (measured in percentage, based on geophysical information);
2. Permeability (measured in mD) (mDarcy);
3. Bottom-hole pressure (direct measurement, in atm);
4. Formation pressure in well zones (direct measurement, in atm);
5. Downhole temperature (direct measurement, in (° C. or ° F.;
6. Clayiness (i.e., clay percentage) (measured in percentage, based on geophysical information);
7. Current oil saturation of rock formation (measured in percentage, based on geophysical information);
8. Stratum pressure (direct measurement, in atm); and
9. Dynamic viscosity under current conditions (measured in mPa's).

Figure 3:
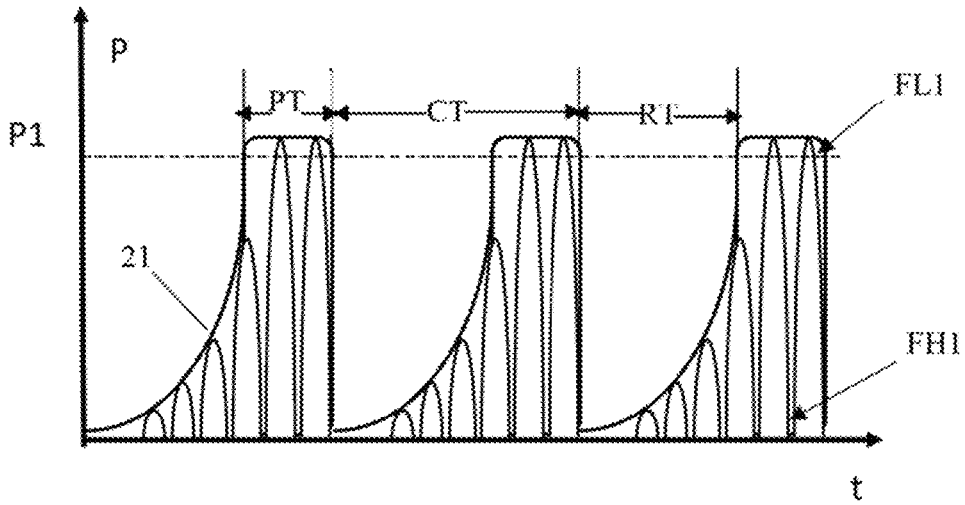
FIG. 3 shows one embodiment of acoustic treatment cycles by the device of the present invention.

The method comprises continuous or periodic synergistic formation treatment with process repetition to achieve and maintain an improved or stabilized water cut during production, increased oil production due to changes in input parameters, and as a result, a greater coefficient of oil or gas production (FIG. 3). The present method leads to increased recoverable reserves of oil or gas in a formation.

The present invention also discloses a methodical technological system designed based on an effect on individual wells, but configured to work not just on individual wells but for the whole formation.

The disclosed system and method accomplish the following objectives:

1. Regulating the process of developing the resource deposit by controlling the discharge front.
2. Identifying formation parts with poor filtration and high residual oil or gas reserves, and including those parts in the filtration process.
3. Identifying and including poorly-draining formations in the filtration process.
4. Continuously controlling the parameters of the acoustic impact process as well as changing parameters of the fluid in the bottom-hole zone while recording data regarding the changing parameters of the fluid and/or formation into a database for further analysis.
5. Automatically or manually changing the acoustic impact parameters on the basis of the above-mentioned recorded data, with the aim of optimizing the acoustic impact.

The proposed invention is unique for the following reasons. Acoustic treatment of an individual well results in changes to the filtration properties of its bottom zone. In the case of treating a single well, depending on the specified objective, the result will be either redistribution of the filtration profile, increased injection/flow rate, or both simultaneously. The stated effects permit an increase in oil production.

However, in the case of separate or individual processing of spatially isolated and hydrodynamically isolated wells, the effect from the separate or individual impact on the formation as a whole is not strong enough. The impact on the specific area of the formation, however, can lead to an increased oil or gas production rate and as a result, increased recoverable reserves from that particular area. The present invention provides a method for impacting various parts of a formation, or the formation as a whole, rather than just one specific area, thus having applicability in treating hydrodynamically connected well systems.

The present invention provides highly selective impacts, low costs, ease-of-use, and complete environmental safety. The present invention is free from the aforementioned disadvantages of known methods for impacting formations. The invention may additionally be implemented in conjunction with known chemical methods in order to raise their effectiveness by increasing reagent penetration depth into a formation.

The present invention increases oil formation productivity, achieved due to the following mechanisms. The invention comprises an impact on a formation by acoustic treatment of two or more adjacent wells, the acoustic effects determined based on formation and oil/gas field analyses. The redistribution of filtration profile flow rates on both ends of the oil or gas stream in the formation (production and injection wells) leads to redistributed streams inside the formation due to changes in the direction and magnitude of pressure gradients. As a result, formation coverage is increased by the flooding process and previously bypassed oil or gas is now included in the filtration process. The technological manifestation of this effect is an increased oil or gas displacement rate, improved or stabilized water cut during production, and/or a cessation of water cut growth, accompanied by an increased recovery of oil or gas. Additionally, the acoustic field produced weakens interphase surface interaction, which leads to decreased fluid viscosity and involvement in the filtration process of volumes of fluid that were previously stationary within the pore radius, under existing development conditions. As a result of the synergistic treatment of a well group according to specified intervals, movement of oil or gas is activated in gas-saturated or oil-saturated sub-layers having poor permeability. The stated mechanisms facilitate control of the displacement agent injection front and thus regulate development of the resource deposit. The end result of implementing this method is an increased oil or gas production coefficient.

The proposed method may be implemented in the following way:

Based on analysis of field data on the distribution of formation pressure, oil or gas recovery, water cut, and injection, formation zones with deteriorating hydrodynamic connections between wells or breaches in the injection front are determined and selected. Maps are created of fluid streams inside selected zones.

Results of geophysical studies of the selected well zones are then analyzed, wherein the analysis is used to determine the frequencies and power of acoustic treatments, key wells, and the time intervals for treating wells or the length of acoustic impact. A calculation of frequency-power parameters of the treatment is performed, depending on the petrophysical properties of the selected zone's formation. The well treatment sequence, with the goal of redistributing hydrodynamic streams, is then determined. If the wells are hydro-dynamically connected, the acoustic treatment is conducted simultaneously. Alternatively, the injection group may be treated first, then after a short interval, the production well is treated (according to the fluid stream map). To control the injection front, a corresponding production well may be treated after an estimated time, required for formation pressure relaxation, following treatment of the injection wells.

Treatment (i.e. acoustic processing) of the individual wells occurs according to the acoustic treatments disclosed in RF Patent No. 2143554 or any other known method for performing an acoustic treatment. The equipment, by means of which the treatment is performed, may comprise any known equipment in the art today, including but not limited to that disclosed in U.S. Patent Application No. 2014/218533 and Russian Patent Nos. RF 2164829, filed Jun. 9, 2000, and RF 2134436, filed Jun. 10, 1999.

In the proposed invention, the acoustic impact is upgraded to improve acoustic impact effectiveness on separate wells and the formation as a whole by means of continuous parameter control of the acoustic impact, fluid parameter changes in the bottom zone, and the continuous recording of the parameter data and any changes/variation into a database in order to optimize the process after initiation.

Automatic or manual changes in acoustic impact parameters are made based on the data indicated above with the aim of optimizing the acoustic impact.

It is necessary to determine the initial setup of the acoustic field in order to include stationary fluid in the filtration process, which will in turn determine the direction "towards" or "against" the pressure gradient ("from" the well, where the acoustic device is placed or "towards" the well), as well as the amount of fluid involved in filtration. The acoustic treatment causes an effect "towards" the pressure gradient for injection wells. And for production wells, the treatment causes an effect "against" the pressure gradient. In both cases, the acoustic device is located inside the well. See attached (FIG. 3).

Figure 4:
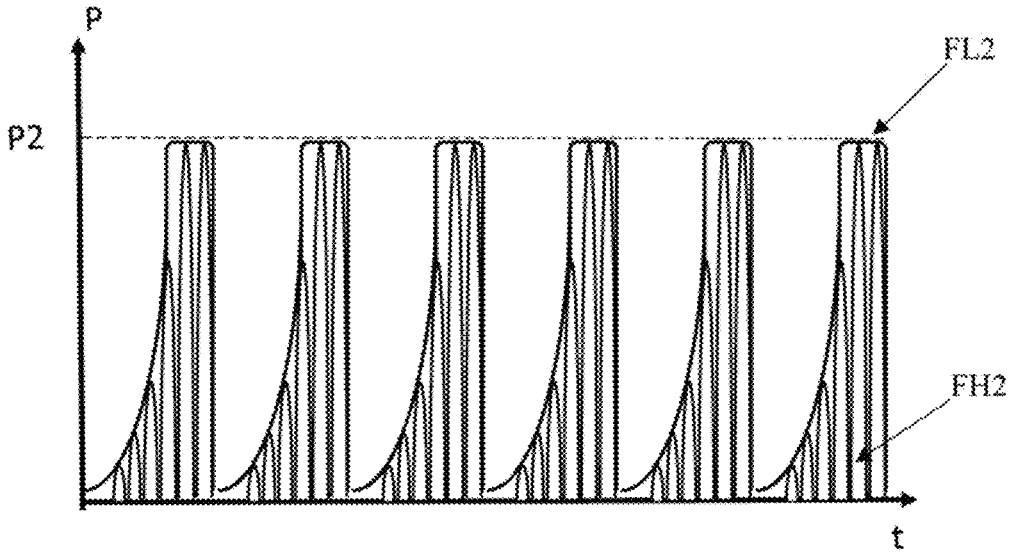
FIG. 4 shows another embodiment of acoustic treatment cycles by the device of the present invention.
Figure 5:
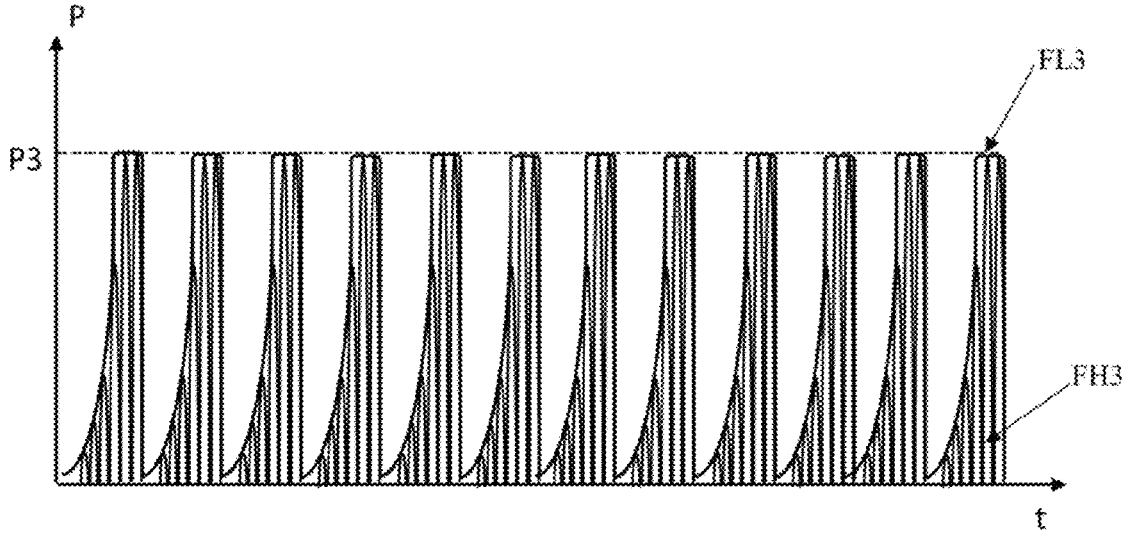
FIG. 5 shows yet another embodiment of acoustic treatment cycles by the device of the present invention.

The present invention comprises the following steps (FIG. 4 shows a data processing flow chart for this one embodiment of the system and method for optimization of an acoustic impact on a formation, in automatic or manual mode):

1. Collection of geophysical data to meet initial criteria to required treatment and calculation of formation parameters to identify those formation parts, or areas, which are decreasing productivity (for example, based on a chart of the speed of production decline; a higher speed of production decline would suggest a need for treatment) 101;

2. Determination of the number and position of key injection and production wells (at least one adjacent pair of wells, or any greater amount of connected wells) on a formation 102;

3. Calculation and setup of variable parameters for each device, to be positioned in wells selected for acoustic treatment. Using the input parameters and criteria for acoustic impact optimization, the initial equipment setup is determined for the given resource deposit conditions 103;

4. Continuous data collection and calculation of formation parameter changes as acoustic treatment continues 105;

5. Determination whether the treatment and setup parameters are either achieving the desired formation parameters or maintaining formation parameters 106;

6. Recalculating and adjusting (i.e. optimizing) of the variable setup parameters for each device in the wells selected for acoustic treatment (at least two devices in at least two wells) when desired formation parameters are not achieved or maintained 108 (feedback loop); and The information obtained is measured continuously, digitized, processed, and optimized, correcting the initial setup of acoustic devices in order to increase gas or oil production. Thus, equipment operates in automatic mode and takes into account acoustic impact optimization. The main setup parameters of the acoustic equipment, which are further adjusted during optimization of the process, are:

1. Power (acoustic pressure);
2. Frequency;
3. Power wave pulse shape.

Analysis of the formation condition and the complex well treatments according to the proposed method on the identified currently ineffective formation zones occurs continuously, based on information being obtained and noted formation changes. Such repetition of treatments allows stabilization or reduction of the rate of water cut increase for the duration of the formation development, maintaining stable oil production from the sub-layers with low permeability, resulting in an increased oil production coefficient and increased recoverable reserves (FIG. 3).

Figure 10:
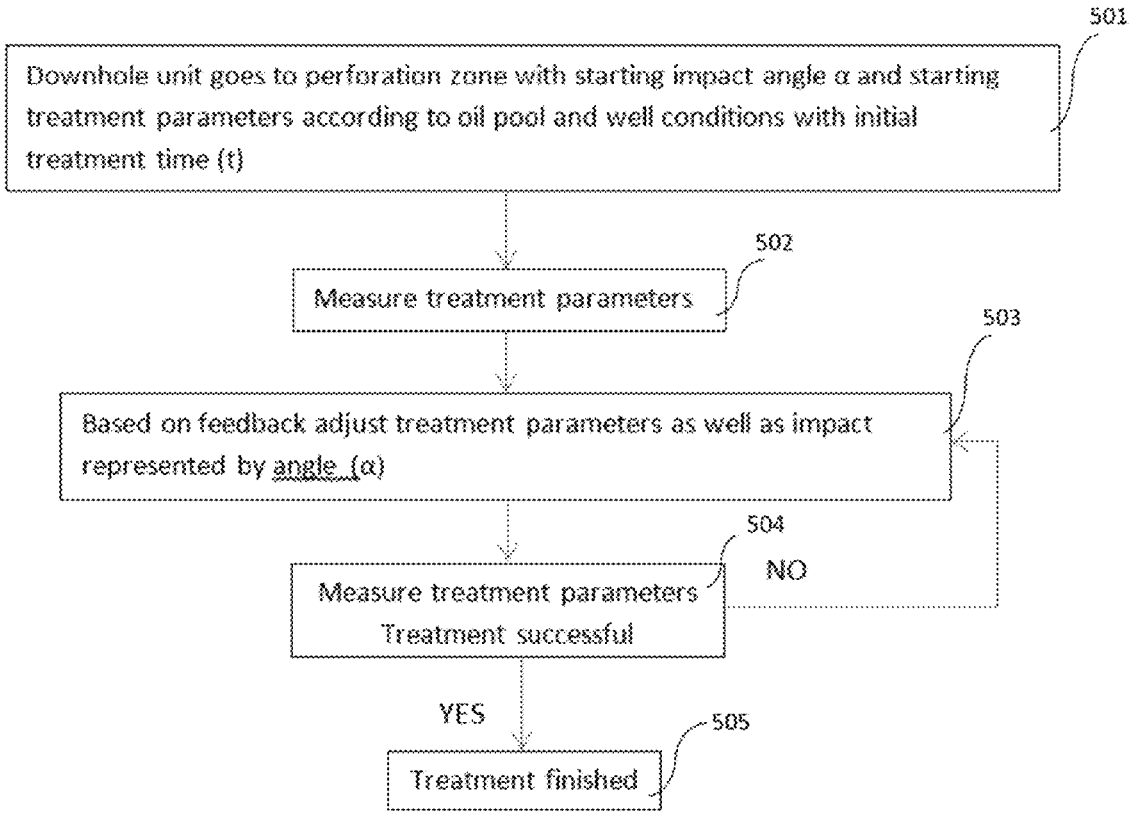
FIG. 10 shows a flowchart detailing an embodiment of the present invention comprising steps for modifying the front impact angle ($\alpha$) in order to optimally treat and impact a perforation or other well zone.
Figure 11:
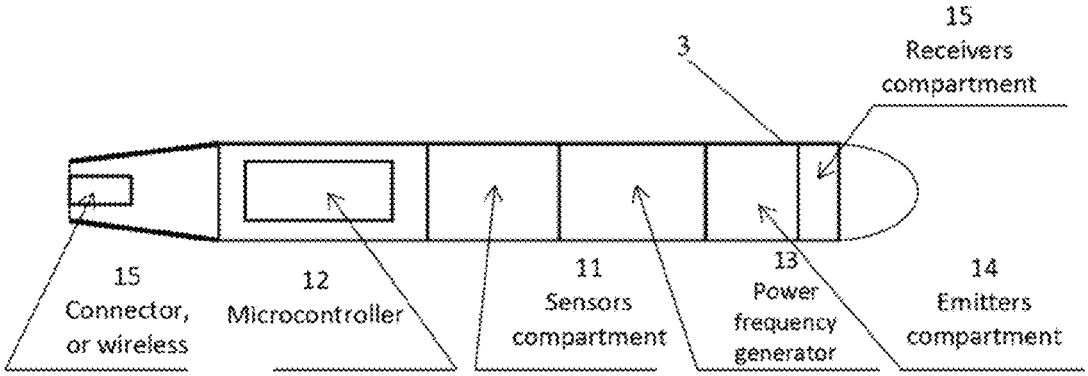
FIG. 11 shows another example of the various components of one embodiment the acoustic device.

FIG. 10 shows a more particular example of the method described above. Namely, FIG. 10 shows the steps employed by the present invention in the case of determining and/or creating an explosive impact as opposed to a normal sine-shaped impact on a well zone. The steps shown in the figure are as follows: First, a downhole unit enters a perforation zone of a well, and the unit begins to perform acoustic impacting according to parameters (including the angle $\alpha$, see FIG. 8) based on initial oil pool and well conditions and the corresponding treatment time 501. Next, and as the unit is working, treatment parameters are measured by another part of the downhole unit 502. Based on a processing of the treatment parameters measurement (or feedback received, as discussed below, or a combination thereof), the device adjusts (or a processor determines that the device adjust) treatment parameters including the impact represented by the angle $\alpha$ 1503. Then, one again, the treatment parameters and conditions of the well are measured 504. If the treatment is measured to be successful, the treatment is stopped 505. Alternatively, if the treatment is measured to be unsuccessful, step 504 is repeated until treatment is determined to be satisfactory. The feedback information and treatment parameters may be combined in any way to provide information to the processor (either within the downhole unit or in a remote location) in order to provide the proper treatment required for each particular well system.

The setup for one embodiment of the presently claimed system and method may be as follows (see FIGS. 1 and 2):

Two acoustic devices 3 are positioned within a particular well (key well) within a system of wells, in this example, the two wells form an adjacent pair of wells, one being an injection well 1 and the other being a production well 2. In the injection well 1, an acoustic device 3 is positioned at or nearby the water layer 4 of the well system, such that the acoustic processing creates an impact on the water layer to increase the water injection rate 7, 10. In the production well, a second acoustic device 3 is positioned at or nearby the oil (or gas) layer 6 of the well system, such that the acoustic processing creates an acoustic impact directed towards the bottom hole formation zone 8, 9, in order to increase the oil stream and thus oil production and extraction). 1 shows acoustic impacts 7, 8 directed it both directions at both wells, in the case that additional wells are connected to the two shown in the illustration.

FIG. 4 shows an example of how a power wave shape, or a power wave pulse shape, may be modified to achieve a greater impact from acoustic treatment on a well zone. A normal sine-like wave 800 is shown in comparison with an altered wave 801. The emitting power is approximately equal in both waves; however, the impact of the altered wave 801 is higher because the pressure rises from zero 81 to a maximum value 83 in a very short time period as compared to the normal sine-like wave 800. The impact from the altered wave 801 is similar to an explosive wave, while the normal wave 800 comprises a more gradual rise. This rise in pressure may be controlled and/or caused by changing the angle α (up to 90°) of the front of the wave the angle formed by the slope of the wave and its relation to the horizontal axis, of the x-axis). The pressure then drops back to zero 82 before the pattern is repeated.

Figure 8:
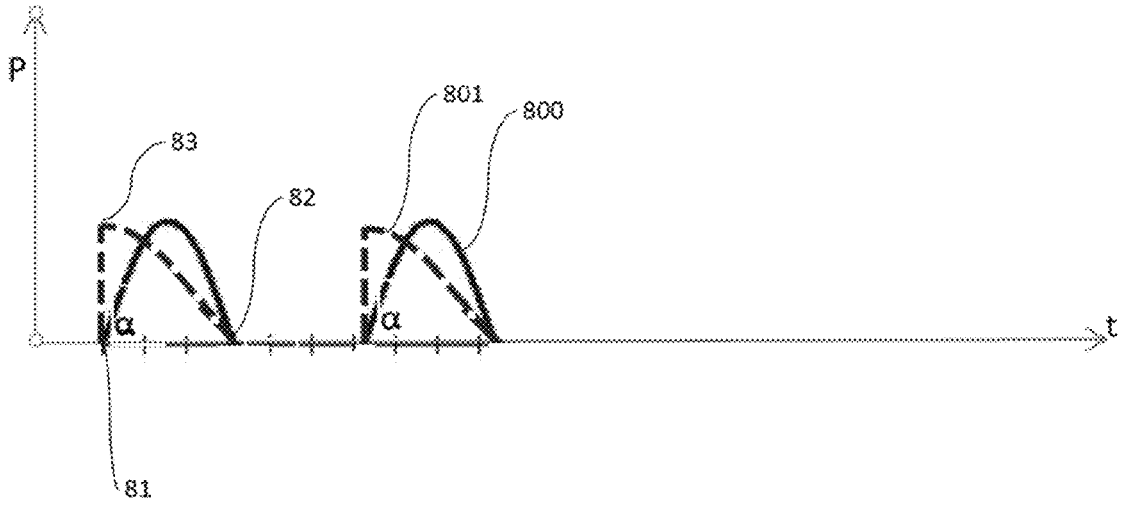
FIG. 8 shows a graphical example of how the shape of a typical sine pressure wave (or power wave) may be altered to create a higher impact by adjusting the wave shape as a function of pressure impact (P) as well as a function of time (t).

Using the example in FIG. 8 as a model, it follows that by changing the amount of time it takes for the pressure to reach its maximum value (i.e., by changing the angle, α, of the front impact line), the present invention allows for control of the impact on a cleaning zone. Thus, based on the feedback loop described above, the present invention if further able to modify the front impact based on particularly detected needs of the specific liquid well being monitored, maintained, and/or restored. Based on the feedback, an automatic control of the impact to achieve optimal treatment results and optimal prevention of oil pool damage from any uncontrolled impact may be employed. It should be noted that the shape illustrated in FIG. 8 is applicable to all frequencies from 4 kHz to 25 kHz during restoration of liquid wells. Furthermore, if treatment is performed via packets of power waves (as described in patent application Ser. No. 14/953,151, which is incorporated by reference fully herein), all frequencies inside each packet may comprise the proposed shape. Alternatively, varying packets may comprise power waves of varying shapes.

Figure 9C:
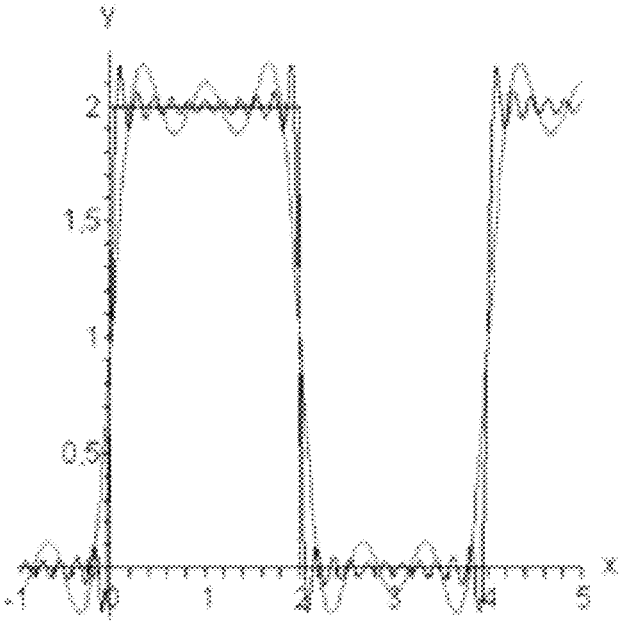
FIGS. 9(*a*)-9(*e*) show additional graphical examples of how a power wave shape me be altered or prescribed, as well as the mathematical relationship (Fourier series of the function) for the various power wave shapes.
Figure 9D:
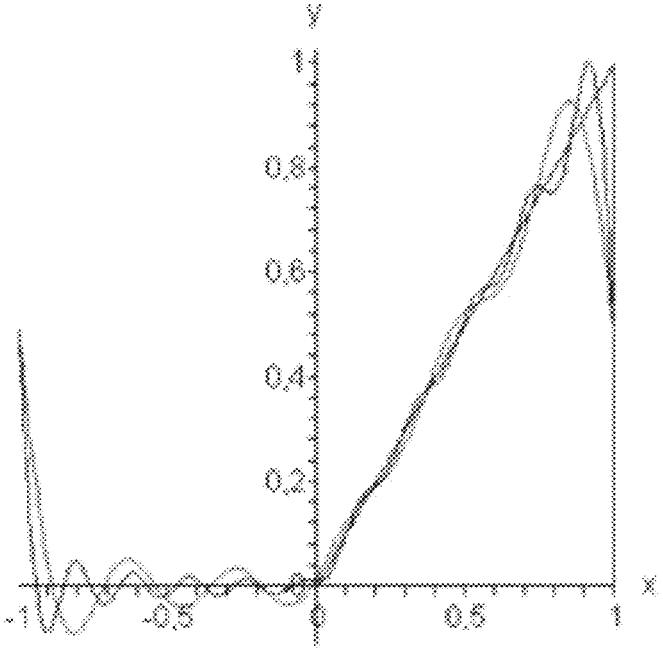
Figure 9E:
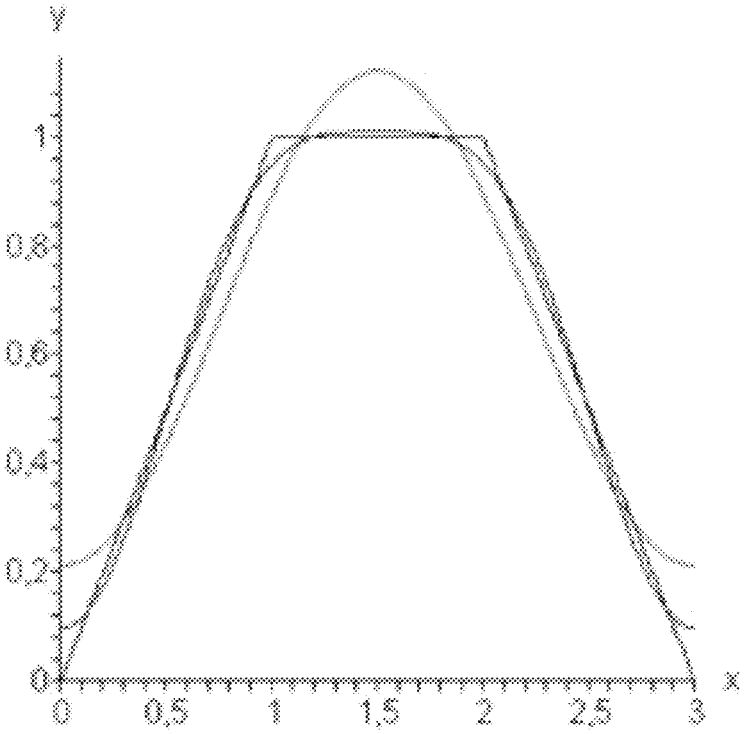

FIGS. 9(*a*) and 9(*b*) show additional graphical examples of how a power wave shape me be altered or prescribed, as well as the mathematical relationship (Fourier series of the function) for the various power wave shapes. FIG. 9(*a*) shows a table explaining three example modifications according to the present invention, as well as their Fourier series equation. FIG. 9(*b*) shows the same three examples but with modified Fourier transformation equations which show the same relationship. The tables comprise 3 rows, each of which corresponds to a different example wave shape employed by the present invention.

Row 1 of FIGS. 9(*a*)-9(*b*) corresponds with FIG. 9(*c*), which shows a specific example of a wave shape where A=2, L=2, n=2, n=10. In this example (Example 1), the steps for configuring a U-shaped wave shape comprise the following:

Find Fourier series expansion of function:

$$f(x) = \begin{cases} A, & 0 \le x \le L \\ 0, & L < x \le 2L \end{cases}.$$

Solution: Define the expansion coefficients:

$$a_0 = \frac{1}{L}\int_a^b f(x)dx = \frac{1}{L}\int_0^L A\,dx = A,$$

-continued $$a_n = \frac{1}{L}\int_a^b f(x)\cos\frac{n\pi x}{L}dx = \frac{1}{L}\int_0^L A\cos\frac{n\pi x}{L}dx = \frac{A}{L}\left(\frac{L}{n\pi}\sin\frac{n\pi x}{L}\right)\Big|_0^L = \frac{A}{n\pi}(\sin n\pi - \sin 0) = 0,$$

$$b_n = \frac{1}{L}\int_a^b f(x)\sin\frac{n\pi x}{L}dx = \frac{1}{L}\int_0^L A\sin\frac{n\pi x}{L}dx = \frac{A}{L}\left(-\frac{L}{n\pi}\cos\frac{n\pi x}{L}\right)\Big|_0^L = \frac{A}{n\pi}(-\cos n\pi - \cos 0) = \frac{A}{n\pi}[1-(-1)^n] = \frac{A}{n\pi}[1+(-1)^{n+1}].$$

Note:

for even values of $n = 2k$, $k = 1, 2, 3, \ldots$ $$b_{2k} = \frac{A}{2k\pi}[1+(-1)^{2k+1}] = 0.$$

For odd values of $n = 2k-1$, $k = 1, 2, 3, \ldots$ $$b_{2k-1} = \frac{A}{(2k-1)\pi}[1+(-1)^{2k}] = \frac{2A}{(2k-1)\pi}.$$

Therefore, the Fourier series expansion has the form:

$$f(x) = \frac{A}{2} + \frac{2A}{\pi}\sum_{k=1}^{\omega}\frac{1}{2k-1}\sin\left(\frac{2k-1}{L}\pi x\right)$$

Row 2 of FIG. 9(*a*)-9(*b*) corresponds with FIG. 9(*d*), which shows specific example of a wave shape where n=5, n=10. In this example (Example 2), the steps for configuring a sawtooth-like shape comprise the following:

Find the Fourier series expansion of function:

$$f(x) = \begin{cases} 0, & -1 \le x \le 0 \\ x, & 0 < x \le 1 \end{cases}.$$

Solution: Here L=1. Therefore, it can be denoted:

$$a_0 = \frac{1}{L}\int_a^b f(x)dx = \int_{-1}^1 f(x)\,dx = \int_0^1 x\,dx = \left(\frac{x^3}{2}\right)\Big|_0^1 = \frac{1}{2}.$$

Calculate the coefficients, $a_n$:

$$a_n = \frac{1}{L}\int_a^b f(x)\cos\frac{n\pi x}{L}dx = \int_0^1 x\cos(n\pi x)dx$$
$$= \left(\frac{1}{n\pi}x\sin(n\pi x)\right)\Big|_0^1 - \frac{1}{n\pi}\int_0^1 \sin(n\pi x)\,dx$$
$$= \frac{1}{n\pi}\left[(x\sin n\pi x)\Big|_0^1 + \left(\frac{\cos n\pi x}{n\pi}\right)\Big|_0^1\right]$$
$$= \frac{1}{n\pi}\left[\sin n\pi + \frac{\cos n\pi}{n\pi} - \frac{1}{n\pi}\right] = \frac{1}{n^2\pi^2}[\cos n\pi - 1]$$
$$= \frac{1}{n^2\pi^2}[(-1)^n - 1].$$

Next deduce coefficients bn:

$$b_n = \frac{1}{L}\int_a^b f(x)\sin\frac{n\pi x}{L}dx = \int_0^1 x\sin(n\pi x)dx$$
$$= \left(-\frac{1}{n\pi}x\cos(n\pi x)\right)\Big|_0^1 + \frac{1}{n\pi}\int_0^1 \cos(n\pi x)\,dx =$$
$$= \frac{1}{n\pi}\left[(-x\cos n\pi x)\Big|_0^1 + \left(\frac{\sin n\pi x}{n\pi}\right)\Big|_0^1\right]$$
$$= \frac{1}{n\pi}\left[-\cos n\pi + \frac{\sin n\pi}{n\pi}\right] = \frac{(-1)^{n+1}}{n\pi}.$$

As a result, the following expression for the Fourier series is obtained (FIG. 9(*d*)):

$$f(x) = \frac{1}{4} + \sum_{n=1}^{\omega}\left[\frac{((-1)^n - 1)}{n^2\pi^2}\cos n\pi x + \frac{(-1)^{n+1}}{n\pi}\sin n\pi x\right].$$

Row 3 of FIG. 9(*a*)-9(*b*) corresponds with FIG. 9(*e*), which shows specific example of a wave shape where n=1, n=3. In this example (Example 3), the steps for configuring a trapezoidal wave shape comprise the following:

Find the Fourier series expansion of trapezoidal wave, of the given function:

$$f(x) = \begin{cases} x, & 0 \le x \le 1 \\ 1, & 1 < x \le 2 \\ 3 - x, & 2 < x \le 3 \end{cases}.$$

Solution: In this case, clearly, L=32. So calculate the expansion coefficients $a_0$ and $a_a$:

$$a_0 = \frac{1}{L}\int_a^b f(x)dx =$$
$$\frac{2}{3}\int_0^3 f(x)dx = \frac{2}{3}\left[\int_0^1 xdx + \int_1^2 dx + \int_2^3 (3-x)dx\right] =$$
$$\frac{2}{3}\left[\left(\frac{x^2}{2}\right)\Big|_0^1 + x\,|_1^2 + \left(3x - \frac{x^2}{2}\right)\Big|_2^3\right] = \frac{4}{3}.$$

$$a_n = \frac{1}{L}\int_a^b f(x)\cos\frac{n\pi x}{L}dx = \frac{2}{3}\int_0^3 f(x)\cos\frac{2n\pi x}{3}dx$$
$$= \frac{2}{3}\left\{\int_0^1 x\cos\frac{2n\pi x}{3}dx + \int_1^2 \cos\frac{2n\pi x}{3}dx + \int_2^3 (3-x)\cos\frac{2n\pi x}{3}dx\right\} =$$
$$= \frac{2}{3}\left\{\left[\left(\frac{3}{2n\pi}x\sin\frac{2n\pi x}{3}\right)\Big|_0^1 - \int_0^1 \frac{3}{2n\pi}\sin\frac{2n\pi x}{3}dx\right] + \left(\frac{3}{2n\pi}\sin\frac{2n\pi x}{3}\right)\Big|_1^2 + + \left[\left(\frac{3}{2n\pi}(3-x)\sin\frac{2n\pi x}{3}\right)\Big|_2^3 + \int_2^3 \frac{3}{2n\pi}\sin\frac{2n\pi x}{3}dx\right]\right\} =$$
$$= \frac{2}{3}\left\{\frac{3}{2n\pi}\sin\frac{2n\pi}{3} + \frac{9}{4n^2\pi^2}\left(\cos\frac{2n\pi}{3} - 1\right) + \frac{3}{2n\pi}\left(\sin\frac{4n\pi}{3} - \sin\frac{2n\pi}{3}\right) - -\frac{3}{2n\pi}\sin\frac{4n\pi}{3} + \frac{9}{4n^2\pi^2}\left(-\cos 2n\pi + \cos\frac{4n\pi}{3}\right)\right\} =$$
$$= \frac{2}{3}\left\{\frac{9}{4n^2\pi^2}\left(\cos\frac{2n\pi}{3} - 1\right) + \frac{9}{4n^2\pi^2}\left(\cos\frac{4n\pi}{3} - 1\right)\right\}.$$

Since cos 4nπ3=cos(2nπ−2nπ3)=cos 2nπ3, we obtain:

$$a_n = \frac{2}{3}\cdot\frac{9}{4n^2\pi^2}\left(\cos\frac{2n\pi}{3} - 1\right) = \frac{3}{n^2\pi^2}\left(\cos\frac{2n\pi}{3} - 1\right),\ n = 1, 2, 3, \ldots$$

Coefficients $b_n$ equal zero, since the function is even at the given interval [0,3]. Then the Fourier series expansion is denoted by the formula:

$$f(x) = \frac{2}{3} - \frac{3}{\pi^2}\sum_{n=1}^{\omega}\frac{1 - \cos\frac{2n\pi}{3}}{n^2}\cos\frac{2n\pi x}{3}.$$

The graph of the given function and the Fourier approximation at n=1 and n=3 are shown in FIG. 9(*e*).

It is further noted that the emitters used for creating the acoustic impact must be fast-acting emitters (e.g., magnetostrictive actuators, electromagnetic actuators with concentrators, fast-responding piezo-ceramic actuators, etc.).

Applications for such devices with a controlled impact include but are not limited to: liquid well rehabilitation, oil field production enhancement, and constant use (e.g., maintenance) on downhole equipment to prevent or minimize decline of oil/liquid well production. In the maintenance example, an ultrasonic emitting device is constantly operating in the well perforation zone to prevent collection of mud, dirt, sint, other materials deposited in capillaries and channels of the oil or liquid well, and materials blocking the channels which increase hydrodynamic resistance and thus cause a decline in production from the well.

Also provided herein are techniques/methods for the optimization of oil wells. Furthermore, devices for selecting oil wells for ultrasound/acoustic stimulation of the oil field are also disclosed (e.g., selecting those wells which are in fact hydrodynamically or otherwise connected, based on experimental evidence obtained while performing an initial treatment as described in this disclosure). Methods for process optimization are provided as well.

In order to select the optimal wells out of a formation/system of wells, the acoustic/ultrasound device according to the present invention is further equipped with a full-spectrum receiver in addition to the transmitter as described above. The full-spectrum receiver of vibrations emitted by the transmitter(s), the receiver being located in other wells and/or a transmitting well, is referred to herein as such (i.e. full-spectrum receiver, or simply, receiver). This term is intended to signify a device that may both emit and receive ultrasound and acoustic vibrations.

Provided below are various examples in which the full-spectrum receiver may be used to determine which wells in a system of wells are hydrodynamically connected, such that signal optimization may be employed to increase and/or restore well productivity according to the present invention.

Technique/method for optimizing selection of oil wells for ultrasound/acoustic stimulation of the oil field.

The main objective of the technique is to locate the well with maximum hydrodynamic connectivity to the most productive well such that the subsequent joint processing of the hydrodynamically-connected wells increases the total productivity of the entire field (several wells, not just one of them).

The distribution, attenuation, and conductivity of ultrasonic waves differ based on the various mediums through which the waves travel. In fluid, which is an incompressible medium, ultrasonic waves conduct significantly well and the cumulative effect of varying ultrasonic waves through a fluid form the basis of the technique of the present invention for detecting hydrodynamically-connected oil wells for other types of wells).

Ultrasound attenuation is the reduction in amplitude and, consequently, intensity of a sound wave as it propagates. Ultrasound attenuation occurs for several reasons. The main reasons are:

1. Decrease in wave amplitude with distance from the source, due to the form and wave size of the source;

2. Ultrasound scattering by medium non-homogeneities, which result in reduced energy flow in the original propagation direction; and 3. Absorption of ultrasound, i.e., irreversible transition of sound wave energy into different forms, particularly into heat.

The first of these reasons relates to the fact that, as the wave propagates from a point or spherical source, the energy emitted by the source is distributed along all of the increasing surface of the wavefront. This therefore reduces the energy flow, i.e., the sound intensity, through each successive surface area unit. For a spherical wave, with wave surface which grows with a distance, r, from the source, as $r^2$, the wave amplitude decreases proportionally, and for a cylindrical wave—this proportional value is $r^{-1/2}$.

Figure 12:
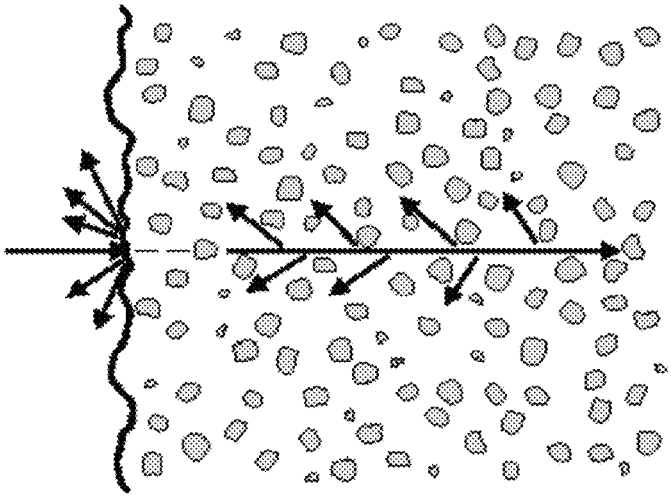
FIG. 12 shows an example illustration of ultrasonic scattering, as discussed and described herein.

Ultrasonic scattering occurs due to sudden changes in medium properties—e.g., density and elastic modulus—at the border with non-homogeneities, whose dimensions are comparable with the wavelength. For gases, this may be, e.g., fluid drops. In an aqueous medium, this may be, e.g., air bubbles. And in solid bodies, this may be, e.g., various foreign inclusions or individual crystallites in polycrystals and on randomly distributed in-homogeneities in the space (see FIG. 12).

For purposes of the present disclosure and explanation, a simple formula for ultrasound absorption is used. It is noted that this formula will provide a larger result compared to the result obtained when taking into account all absorption factors, but for comparing the signal fading in the formation with the signal fading in the hydrodynamically-connected wells, this formula is sufficient.

Ultrasound fading caused by scattering and absorption is denoted by the exponential law of decreasing amplitude with distance, i.e., amplitude is proportional to $e^{-\delta \cdot r}$, intensity is proportional to $e^{-2\delta \cdot r}$, as opposed to the exponential law of decreasing amplitude with wave divergence where δ is the ultrasound attenuation coefficient.

The attenuation coefficient is expressed either in decibels per meter (dB/m), or in nepers per meter (Np/m).

For a plane wave, the attenuation coefficient using amplitude and distance is calculated using Formula 1 (1):

$$\alpha = \frac{1}{L}\ln\left(\frac{p(0)}{p(L)}\right); \tag{1}$$

Where α=attenuation coefficient by distance (1/m), L=distance (m), and p(0)/p(L)=amplitude of sound pressure at the source point, 0, and at a distance, L (Pa).

The attenuation coefficient by time is calculated by Formula 2:

$$\beta = \frac{1}{T}\ln\left(\frac{p(0)}{p(T)}\right); \tag{2}$$

Where β=attenuation coefficient by time (1/s), T=time (s), and p(0)/p(T)=amplitude of sound pressure at the beginning, 0, and after time, T, (Pa).

For measuring the coefficient, dB/m units may also be used (i.e., decibels per meter). In this case, this provides another formula, Formula 3:

$$\alpha = \frac{1}{L}20lg\left(\frac{p(0)}{p(L)}\right); \tag{3}$$

This calculation represents a logarithmic unit of measurement for the energy or power ratio in acoustics, i.e. the decibel. The decibel may also be calculated using Formula 4:

$$\text{dB} = 20lg\left(\frac{A_1}{A_2}\right); \tag{4}$$

where A1=amplitude of a first signal, and A2=amplitude of a second signal.

Therefore, and based on Formulas 3 and 4, the ratio between the units of measurement, (dB/m) and (1/m), is provided as Formula 5:

$$\alpha\ (\text{dB/m}) = 8.686\alpha\ (1/\text{m}) \tag{5}.$$

The formulas shown above are used to calculate signal attenuation in the formation, but in the absence of ultrasound fluid, the ultrasound will attenuate in the formation very rapidly, and with practically no hydrodynamic connectivity between wells, it will attenuate down to the level of noise. In this case, a second reading of the environmental (i.e. natural without incorporating the effect of the signal emitted by a first device in a first well) noise level by a receiver located on an additional acoustic device in an additional well will match the initial signal (after standardization).

In contrast, when there is a hydrodynamic connection between wells, the ultrasound will be registered by the receiver devices at significantly higher-than-noise-level amounts, depending on factors such as the channels located between the wells and how much fluid exists therein. The more channels and fluid connecting the wells, the stronger the receiver will register the ultrasound signal. Thus, in this case, a second reading of the noise level would be significantly lower than the initial signal (after standardization). This is the effect around which the techniques for selecting hydrodynamically-connected wells set forth herein are designed.

Example 1

One simple method for finding hydrodynamically-connected oil wells is based on known geophysical data:

1.1.1. According to geophysical data and information on productivity the most productive well, well 0, is chosen (see FIG. 13, for visual reference)

Figure 13:
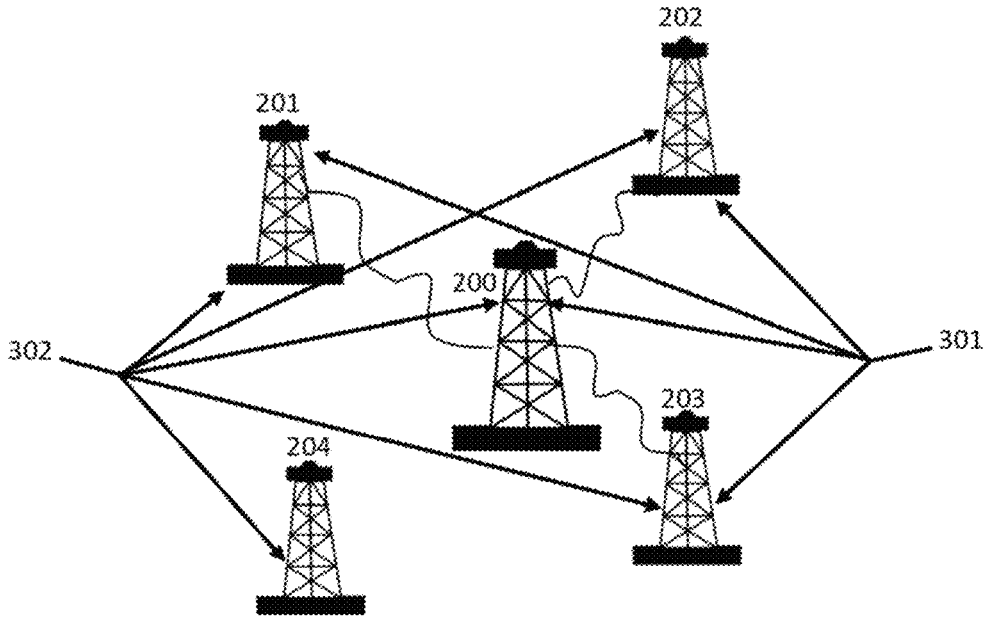
FIG. 13 shows an example of a system of wells, a majority of which are hydrodynamically connected. This particular example helps illustrate Example 2 of the detecting and maintenance methodology of the present invention, provided hereinbelow.

1.1.2. Device for emitting ultrasound/acoustic frequency is placed in well 200, the most productive well 200 within a system of wells. All five wells shown in FIG. 13 are characterized as surrounding wells 302 with less production than well 200. Four of the five wells illustrated are hydrodynamically-connected wells 301, based on known information and presumed for this example.

1.1.3. According to data from the geophysical exploration, select another well, which is presumed or known to be hydrodynamically-connected to well 200, for purposes of this example, well 202 is selected.

1.1.4. In wells 201, 202, 203, and 204, devices according to the present invention are placed in the surrounding wells that will receive ultrasound/acoustic frequencies.

1.1.5. An experiment is conducted wherein the transmitter in well 200 will emit a signal in different ranges, and the receiving devices placed in wells 201, 202, 203, and 204 will receive and record the signal.

1.1.6. Since it is known from the geophysical studies in this particular example that well 200 and well 202 are hydrodynamically-connected, the signal received at well 202 is accepted as the starting point (i.e. a standard value for comparison).

1.1.7. Signals received at wells 201, 203, and 204, are recalculated (i.e. standardized), taking into account their distances from well 200. If the recalculated signals are proportional to those of wells 201 and 292, then this suggests that these wells are hydrodynamically-connected. The signal detected in well 204 will most likely be zero because this well is not hydrodynamically-connected to die rest, and the signal will instead be absorbed by the rock formation. A value representing likelihood of connectivity between wells is then provided by a processing system capable of performing such calculations. In this example, such a value is determined based on a proportionality between received and standardized signals.

Example 2

Another method for finding hydrodynamically-connected oil wells, e.g. when the geophysical data regarding the geological formation of the oil field is known but data on hydrodynamic connectivity between wells is absent, is provided below:

1.1.1. According to geophysical data and information on productivity, the most productive well, well 200, is chosen (FIG. 13).

1.1.2. Device for emitting ultrasound/acoustic frequency is placed in well 200.

1.1.3. According to geophysical exploration data, the ultrasonic/acoustic frequency absorption of the geological formation is calculated.

1.1.4. In wells 201, 202, 203, and 204, those surrounding the most productive well, receiving devices (or devices comprising receivers) according, to the present invention are placed for receiving ultrasonic/acoustic frequencies.

1.1.5. An experiment is conducted wherein the transmitter in well 200 emits a signal in a different range, and the devices placed in wells 201, 202, 203, and 204 will receive and record the signal.

1.1.6. Signals received by wells 201, 202, 203, and 204 are processed and if, e.g., the calculation shows that for wells 201, 202, 203, the received signal is greater than the calculated one, taking into account formation absorption without taking into account the hydrodynamic connectivity of the wells, this means that the wells are hydrodynamically-connected. The signal at well 204 will most likely be zero because this well is not hydrodynamically-connected to the rest and the signal will scatter on the rock formation (this information is presumed for this and the previous examples only). In this example, the determining step is based on a relativity between two or more received signals, said relativity being based on a known emission from said first acoustic device.

Optimization of Oil Field Processing.

After finding the hydrodynamically-connected wells, the devices located in these wells are powered on for processing. After simultaneous processing of the hydrodynamically-connected wells, the productivity of the entire system of oil fields increases, and such productivity is further scalable using the same steps as described above.

Figure 14:
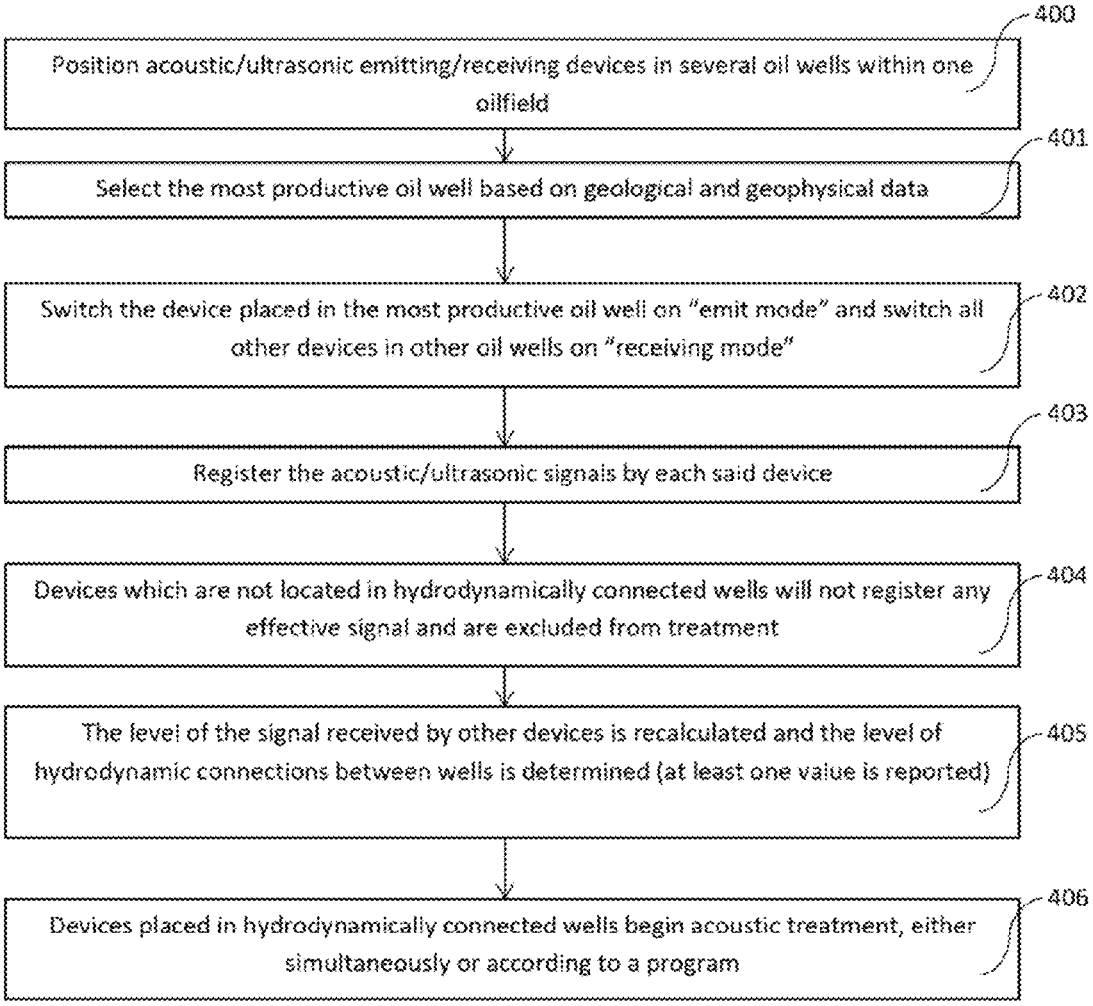
FIG. 14 shows a flowchart illustrating an exemplary method for finding hydrodynamically connected oil wells, located within the same geological or other formation (e.g., oil field), as described hereinbelow.

FIG. 14 illustrates, via a flowchart, one example of this method of optimization of oil field processing. Namely, the figure describes the process as such: (1) Acoustic/ultrasonic emitters/receivers are positioned in several (at least two) wells within one oilfield 400; (2) The most productive oil well is selected, in this example, based on known geological and geophysical data 401; (3) The device placed in the most productive oil well is switched to "emit" mode (i.e., in order to emit an ultrasonic, acoustic, or combined signal), while all other devices are switched to "receiving" mode (i.e., in order to receive the signal(s) emitted by the emitting device in the most productive well 402; (4) Registering the signals by each receiving, device, based on the emitted signal (and knowledge of what to expect) 403; (5) The devices located in hydrodynamically connected wells will register a sufficient signal based on what is expected and known to be emitted from the most productive well, while devices which are located in non-hydrodynamically connected wells will not register an effective signal and will thus be excluded from the rest of the method of this example 404; (6) The level of signal is recalculated (i.e., standardized) and the level of hydrodynamic connection between wells is determined (and at least one value is reported based on this recalculation) 405; (7) Devices which are positioned in sufficiently hydrodynamically connected wells (determined, in this example, based on matching a threshold standardized value) begin an acoustic treatment, either simultaneously or according to a program 406.

The description of a preferred embodiment of the invention has been presented for purposes of illustration and description. It is not intended to be exhaustive or to limit the invention to the precise forms disclosed. Obviously, many modifications and variations will be apparent to practitioners skilled in this art. It is intended that the scope of the invention be defined by the following claims and their equivalents.

Moreover, the words "example" or "exemplary" are used herein to mean serving as an example, instance, or illustration. Any aspect or design described herein as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

What is claimed is:

1. A method for restoring, maintaining, or increasing oil or gas productivity of a geological formation via locating maximum hydrodynamic connectivity between wells located in said geological formation, comprising:

positioning a first acoustic/ultrasonic device in a first well located within said geological formation, positioning one or more additional acoustic/ultrasonic devices in one or more additional wells located within said geological formation, emitting one or more signals in one or more ranges, said emitting being performed by said first acoustic/ultrasonic device, said one or more signals including both ultrasonic and acoustic signals, wherein said one or more signals including a Fourier transformation of a periodic function, receiving said one or more signals, said receiving being performed by a receiver located on the one or more additional acoustic/ultrasonic devices, standardizing said one or more signals received, said standardizing being based at least in part on a distance between said one or more additional wells and said first well, thus forming one or more standardized figures representing each signal received, determining a value representing a likelihood of hydrodynamic connectivity between said first well and said one or more additional wells, said value being based on a comparison of signals, and performing an acoustic/ultrasonic processing of said first well and any additional wells determined to be hydrodynamically connected to said first well to increase productivity of an entire system of oil field.

2. The method of claim 1, wherein said value is based on a proportionality between emitted signals and received signals.

3. The method of claim 1, wherein said value is based on a relativity between two or more received signals, said relativity being calculated based on a known emission from said first acoustic/ultrasonic device.

4. The method of claim 1, wherein said value accounts for a decrease in wave amplitude due to a distance of said one or more additional wells from said first well.

5. The method of claim 1, wherein said value accounts for an ultrasound scattering by medium non-homogeneities.

6. The method of claim 1, wherein said value representing a likelihood of hydrodynamic connectivity between said first well and said one or more additional wells is compared to a second value, said second value being based on a second signal received by said one or more additional acoustic/ultrasonic devices, said second value representing a level of environmental noise within said geological formation, wherein matching values indicate a non-connected well system, and wherein non-matching values indicate a hydrodynamically connected well system.

7. The method of claim 1, wherein said first well is a most productive well within said geological formation.

8. The method of claim 1, wherein said value is based on a geophysical data of said geological formation.

9. The method of claim 1, wherein said determining of said value is void of a geophysical data of said geological formation.

10. The method of claim 1, wherein at least two additional acoustic/ultrasonic devices in at least two additional wells are used, such that a third device is placed in at least one tertiary well, wherein one of said at least two additional wells is known to be hydrodynamically connected to said first well, and wherein a connectivity between said first well and said at least one tertiary well is determined based on a comparison between signals received at each of said at least two additional wells.

11. A method for restoring, maintaining, or increasing oil or gas productivity of a geological formation via locating maximum hydrodynamic connectivity between wells located in said geological formation, comprising:

positioning a first acoustic/ultrasonic device in a first well located within the geological formation, positioning one or more additional acoustic/ultrasonic devices in one or more additional wells located within the geological formation, emitting one or more signals in one or more ranges, said emitting being performed by said first device, said one or more signals comprising both ultrasonic and acoustic signals, wherein the one or more signals comprises a Fourier transformation of a periodic function, receiving of said one or more signals, said receiving being performed by a receiver located on the one or more additional devices, standardizing said one or more signals received, said standardizing being based at least in part on a distance between said one or more additional wells and said first well, thus forming one or more standardized figures representing each signal received, and determining a value representing a likelihood of hydrodynamic connectivity between said first well and said second well, said value being based on a comparison of signals, wherein the determining step accounts for an absorption of ultrasound or an absorption of an acoustic signal.

12. The method of claim 11, wherein the absorption of ultrasound or the absorption of an acoustic signal is accounted for by the formula, $\alpha$ (dB/m)=8.686$\alpha$ (1/m).

13. A system for restoring, maintaining, or increasing oil or gas productivity of a geological formation via determining hydrodynamic connectivity values between wells located in said geological formation, comprising:

a first acoustic/ultrasonic device positioned in a first well located within said geological formation, one or more additional acoustic/ultrasonic devices positioned in one or more additional wells located within said geological formation, wherein said first acoustic/ultrasonic device emits one or more signals in one or more ranges, said one or more signals including both ultrasonic and acoustic signals, wherein said one or more signals including a Fourier transformation of a periodic function, a receiver for receiving said one or more signals, said receiver being located on said one or more additional acoustic/ultrasonic devices, a processor for standardizing said one or more signals received, said processing being based at least in part on a distance between said one or more additional wells and said first well, said processor forming one or more standardized figures representing each signal received, said processor controlling an acoustic/ultrasonic processing of said first well and any additional wells determined to be hydrodynamically connected to said first well to increase productivity of an entire system of oil field, and a calculator, said calculator determining a value representing a likelihood of hydrodynamic connectivity between said first well and said one or more additional wells, said value being based on a comparison of signals.

14. The system of claim 13, wherein the first well is a most productive well within said geological formation.

15. The system of claim 13, wherein said value representing a likelihood of hydrodynamic connectivity between said first well and said one or more additional wells is compared to a second value, said second value being based on a second signal received by said one or more additional acoustic/ultrasonic devices, said second value representing a level of environmental noise within the formation, wherein matching values indicate a non-connected well system, and wherein non-matching values indicate a hydrodynamically connected well system.

16. The system of claim 13, wherein at least two additional acoustic/ultrasonic devices in at least two additional wells are used, such that a third acoustic/ultrasonic device is placed in at least one tertiary well, wherein one of said at least two additional wells is known to be hydrodynamically connected to said first well, and wherein a connectivity between said first well and said at least one tertiary well is determined based on a comparison between signals received at each of said at least two additional wells.

17. The system of claim 13, wherein the system further performs an acoustic treatment, said acoustic treatment comprising a joint processing of the first well and any additional wells determined to be hydrodynamically connected to the first well.

18. The system of claim 13, wherein said processor accounts for all three of: (1) a decrease in wave amplitude due to a distance of said additional well from said first well, (2) an ultrasound scattering by medium non-homogeneities, and (3) an absorption of ultrasound.

19. The system of claim 18, wherein the absorption of ultrasound is accounted for by a formula, $\alpha$ (dB/m)=8.686$\alpha$ (1/m).

* * * * *